US007075044B2

(12) United States Patent
Ryu et al.

(10) Patent No.: US 7,075,044 B2
(45) Date of Patent: Jul. 11, 2006

(54) INDUCTION HEATING COOKING APPARATUS, OPERATION OF WHICH IS INTERRUPTED BY CONTAINER ECCENTRICITY

(75) Inventors: Seung Hee Ryu, Kyungki-do (KR); Eui Sung Kim, Kyungki-do (KR); Byeong Wook Park, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/219,852

(22) Filed: Sep. 7, 2005

(65) Prior Publication Data

US 2006/0054617 A1 Mar. 16, 2006

(30) Foreign Application Priority Data

Sep. 8, 2004 (KR) ..... 10-2004-0071822

(51) Int. Cl.
*H05B 6/08* (2006.01)
*H05B 6/12* (2006.01)

(52) U.S. Cl. ..... 219/626; 219/665; 219/668; 219/518

(58) Field of Classification Search ..... 219/625–627, 219/661–668, 518; 99/451, DIG. 14
See application file for complete search history.

(56) References Cited

U.S. PATENT DOCUMENTS 4,467,165 A * 8/1984 Kiuchi et al. ..... 219/664
4,540,866 A * 9/1985 Okuda ..... 219/664

* cited by examiner

*Primary Examiner*—Philip H. Leung
(74) *Attorney, Agent, or Firm*—Birch, Stewart, Kolasch & Birch, LLP

(57) ABSTRACT

An induction-heating cooking apparatus, operation of which is interrupted by container eccentricity is disclosed. Upon receiving an input signal varying with the degree of eccentricity of a container, the apparatus changes a reference signal for determining the presence or absence of a small load in proportion to a pulse-width control signal controlling the width of an inverter driving pulse. Although the eccentricity of the container occurs in a normal heating operation and completely escapes from a cook zone, the apparatus determines the occurrence of a no-load state, and interrupts an operation of an inverter circuit, resulting in increased stability of a circuit and a product.

8 Claims, 5 Drawing Sheets

INDUCTION HEATING COOKING APPARATUS, OPERATION OF WHICH IS INTERRUPTED BY CONTAINER ECCENTRICITY

BACKGROUND OF THE INVENTION

1. Field of the Invention

The present invention relates to an induction heating cooking apparatus for determining the presence or absence of a no-load state in which container eccentricity occurs in a normal heating operation and completely escapes from a predetermined cook zone, interrupts an operation of an inverter circuit if the presence of the no-load state is determined, and thus increases stability of a circuit system.

2. Description of the Related Art

Generally, a cooking appliance (also called a cooking apparatus) includes: a main body having a control board capable of determining whether a power-supply signal is received upon receiving a command signal from a user; a cooking container seated in the main body, for including food therein; and a cooking heater installed to a lower part of the cooking container or an inner side of the main body to cook the food included in the cooking container.

An induction-heating scheme applies a current signal to a coil formed in the main body, and allows an induction current to be generated in a magnetic container due to a magnetic field generated by the current signal applied to the coil, thereby heating the container. A variety of cooking appliances, for example, a rice cooker, a pan, a cook-top, a halogen range, an HOB, and a slow cooker, etc., have been designed to use the above induction-heating scheme.

An inverter circuit for use in the above-mentioned induction-heating cooking apparatuses switches on or off a switch formed of an IGBT (Insulated Gate Bipolar Transistor), applies a high-frequency current having high power to the coil, and heats the container located on the coil.

Particularly, the induction-heating electric rice cooker has been designed to prevent the container from incurring the eccentricity from the center of the coil when the container (i.e., an inner pot) is seated in an outer case of the main body. However, other cooking apparatuses such as the cook-top may incur the eccentricity of the container spaced apart from a predetermined cook zone, such that the resonance inductance is changed according to the degree of the container eccentricity. As a result, the food may be unevenly cooked, or a circuit malfunction may occur.

In the meantime, an induction heating cooking apparatus includes: a main body; a container seated in the main body, for including food therein; and a coil installed in either a lower part of the container or an inner part of the main body so that it provides the container with heat to cook the food included in the container.

The induction heating cooking apparatus includes a key entry unit for entering a cooking command to heat/cook or warm the food included in the container; an inverter circuit connected to the key entry unit, for adjusting a current applied to the coil according to the cooking command; and a microprocessor for controlling an operation frequency of the inverter circuit.

In this case, the inverter circuit has been designed to have a unique value of the coil acting as an inductor and a unique resistance value so that it has resonance inductance equal to a frequency of an AC power-source. The inverter circuit changes the inductance according to categories of a magnetic container connected to the coil or the degree of eccentricity of the container, resulting in a complicated circuit design.

If a cooking apparatus such as a cook top shown in FIG. 1 includes a container having eccentricity and is heated, the resonance inductance is changed and is different from a predetermined inductance designed in a circuit, such that the food may be unevenly cooked, or a circuit malfunction may occur.

In other words, if a radius of a cook zone is set to a predetermined radius of D, the resonance is increased whereas resistance is reduced, in proportion to a distance D from the center of the cook zone to the center of a seated point of the heating container, a variation of output power depending upon the above-mentioned characteristics will hereinafter be described with reference to FIG. 2. In FIG. 2, an x-axis is an operation frequency depending on the variation of resonance inductance due to the container eccentricity, and a y-axis is an output power depending on the same.

As shown in FIG. 2, an inverter operation frequency is inversely proportional to the output power. The inverter circuit reduces an operation frequency from an initial operation frequency (F1) of 40 kHz for an initial stable driving operation to a normal operation frequency (F2) of 23 kHz at which normal power is generated. If a voltage (i.e., an input voltage of Vin) between both ends of a coil connected to a container is less than a reference voltage Vref, the inverter circuits stops driving. This is called a small load detection state. If a cooking load less than a reference load is detected, the small load detection state is used to block the circuit from being operated, resulting in increased circuit stability.

When normal power is generated because the initial operation frequency F1 is changed to the normal operation frequency F2, if the value of D is increased, a conventional inverter circuit reduces the inverter operation frequency in proportion to the resonance inductance, such that it performs a constant output control function.

When the degree of eccentricity is increased and the heating container is seated at a specific point completely spaced apart from a predetermined cook zone, a no-load state is established. In this case, the conventional inverter circuit reduces the inverter operation frequency to a maximum operation frequency (F3) of 20 kHz, as denoted by a bold-dotted line in FIG. 2.

In FIG. 2, G1 is indicative of a state in which the heating container is located at the center of a cook zone, G2 is indicative of a state in which the heating container incurs eccentricity by a predetermined value of D/2, G3 is indicative of a state in which the heating container incurs eccentricity by a predetermined value of D, and G4 is indicative of the ratio of the operation frequency to the output power when the heating container completely escapes from the cook zone via the D point. Therefore, as the degree of eccentricity of the heating container is increased, the bold-dotted line moves from the G1 line to the G4 line.

As shown in FIG. 3, the inverter circuit reduces the operation frequency as the container moves from an initial driving period T1 to a normal operation interval T2 according to the variation of the input voltage Vin in such a way that it performs a constant output control function capable of maintaining the output power at a predetermined level, such that it can provide the container with a constant heating source.

If the eccentricity of the container occurs at T3, an input voltage Vin applied to the circuit is reduced, an operation frequency is reduced to establish a constant output control function. The operation frequency is not reduced to the minimum operation or less frequency F3 defined by a circuit designer, such that the switching operation of the inverter is maintained and the power of P3 is generated. Therefore, there arises the power higher than the minimum power of P1 to be generated when the designer determines a no-load state.

Therefore, if the cooking container incurs high-eccentricity and escapes from a predetermined cook zone as denoted by T4 in FIG. 3, the input signal Vin applied to the circuit is still higher than the reference signal Vref, so that a microprocessor mistakes as if the container was in the cook zone without detecting the no-load state, thereby maintaining the driving of the inverter.

The signal Vfd shown in FIG. 3 is indicative of a signal applied to the microprocessor. If the Vfd signal is set to 1, the driving of the inverter is maintained. If the Vfd signal is set to zero, the inverter stops operation. If the input signal Vin is higher than the reference signal (Vref), the Vfd signal is 1.

However, as can be seen from FIG. 3, although the container completely escapes from the cook zone due to the eccentricity of the container during a normal heating period as denoted by T4, the input signal Vin is equal to or higher than the reference signal Vref, so that the Vfd signal is maintained at the value of 1. As a result, the microprocessor does not detect the no-load state, such that it continuously operates the inverter circuit.

In conclusion, the inverter circuit is continuously driven under the no-load state, so that the coil is continuously heated, resulting in deterioration of circuit stability and unnecessary power consumption.

SUMMARY OF THE INVENTION

Therefore, the present invention has been made in view of the above problems, and it is an object of the invention to provide an inverter circuit for synchronizing a reference signal (Vref) used to detect a small load with a pulse-width control signal, such that the reference signal (Vref) can be changed to another signal.

It is another object of the present invention to provide an induction-heating cooking apparatus for determining the presence or absence of a no-load state in which container eccentricity occurs in a normal heating operation and completely escapes from a predetermined cook zone, compulsorily interrupts a switching operation if the presence of the no-load state is determined, and thus increases stability of a circuit system and guarantees stability of a cooking apparatus.

In accordance with the present invention, these objects are accomplished by providing an induction-heating cooking apparatus, operation of which is interrupted by container eccentricity comprising: a power-supply unit for rectifying/filtering an AC power-supply signal, and providing a circuit of the induction-heating cooking apparatus with a power-supply signal; and an inverter unit for performing a switching operation upon receiving an input signal Vin from the power-supply unit, and transmitting a current signal to a coil on which a cooking container is seated.

The induction-heating cooking apparatus further comprises: a constant-output controller for generating a pulse-width control signal Vc to vary a width of a driving pulse applied to the inverter unit according to an input signal varying with the degree of eccentricity of the cooking container, such that it allows the inverter unit to generate a constant-output signal; a small-load detector connected to an output terminal of the constant-output controller, for determining the absence of a cooking load when the input signal Vin is less than a reference signal Vref synchronized with the pulse-width control signal Vc, and generating a feedback signal Vfd to interrupt an operation of the inverter unit; and a microprocessor for transmitting a constant-output control signal to the constant-output controller to allow the inverter unit to generate the constant-output signal, and interrupting the operation of the inverter unit when the feedback control signal Vfd is zero.

The above-mentioned induction-heating cooking apparatus controls the reference signal Vref for detecting a small load to be synchronized with the pulse-width control signal generated from the constant-output controller. If the eccentricity of the container occurs in the normal heating operation and completely escapes from the cook zone, the microprocessor determines the occurrence of a no-load state, so that the operation of the inverter circuit can be blocked, resulting in increased stability of a circuit system and products.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Figure 1:
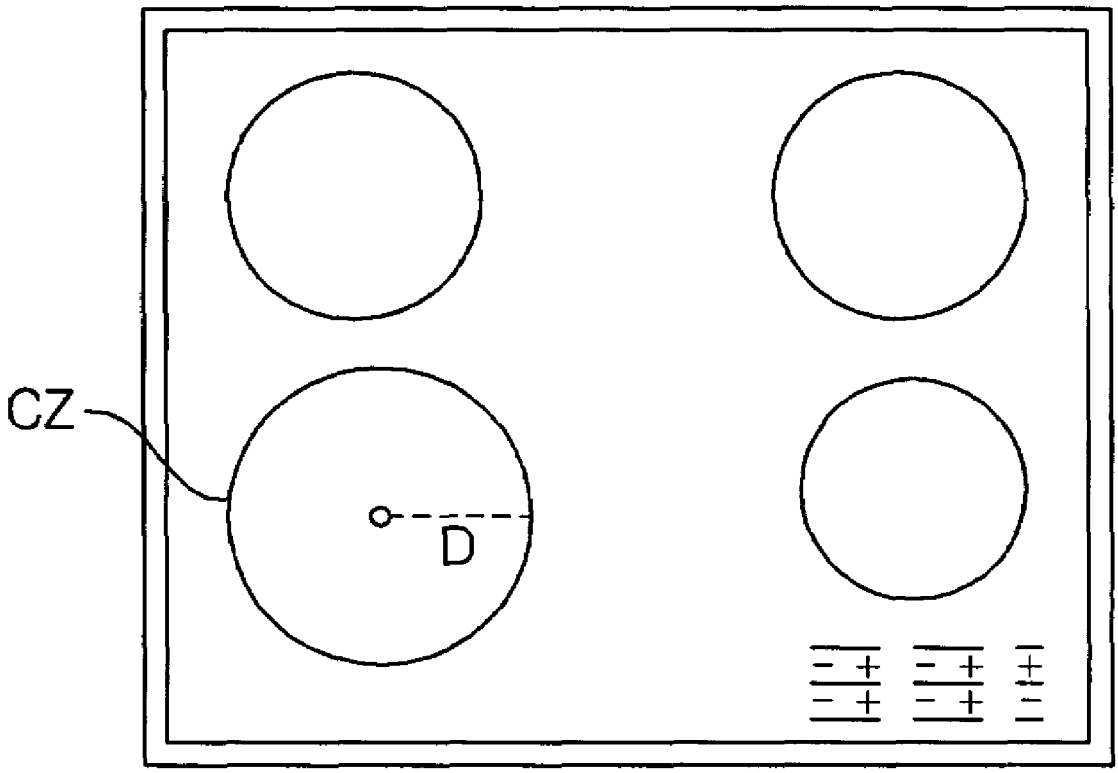
FIG. 1 (Prior Art)
FIG. 1 shows the appearance of a cook zone of a conventional induction-heating cooking apparatus.
Figure 2:
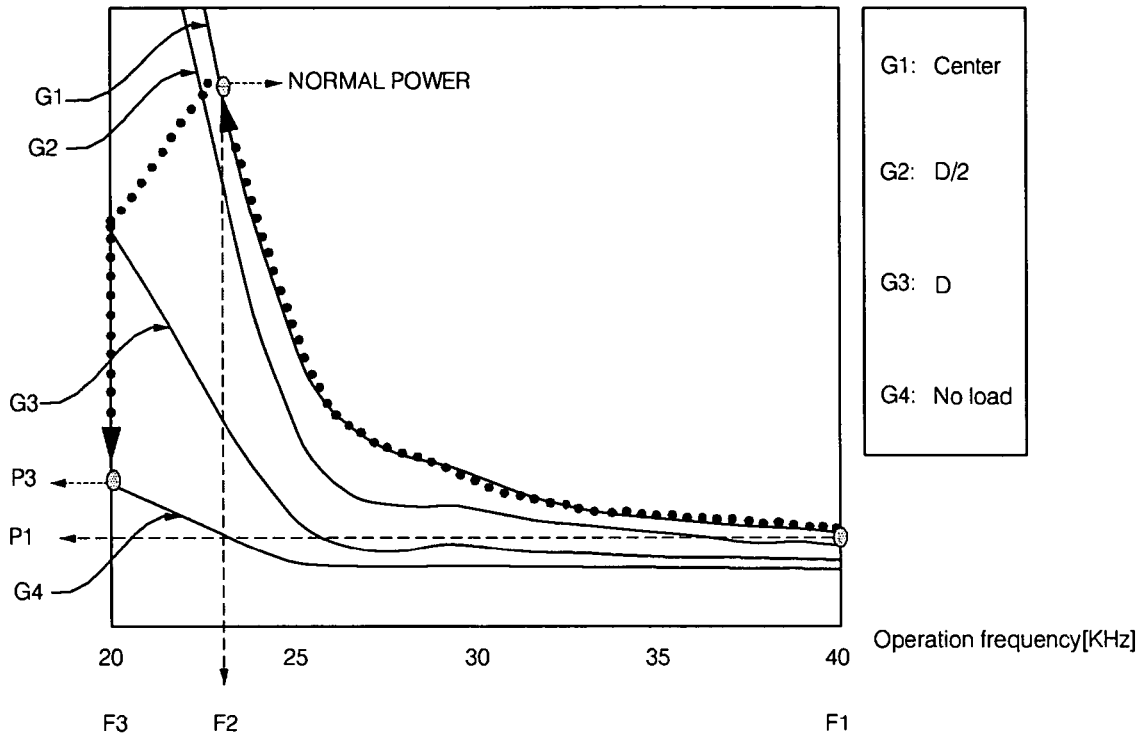
FIG. 2 (Prior Art)
FIG. 2 is a graph illustrating various power levels of individual operation frequencies according to the eccentricity of a container for use in the conventional induction-heating cooking apparatus.

Now, preferred embodiments of the present invention will be described in detail with reference to the annexed drawings. In the drawings, the same or similar elements are denoted by the same reference numerals even though they are depicted in different drawings. In the following description, a detailed description of known functions and configurations incorporated herein will be omitted when it may make the subject matter of the present invention rather unclear.

Figure 4:
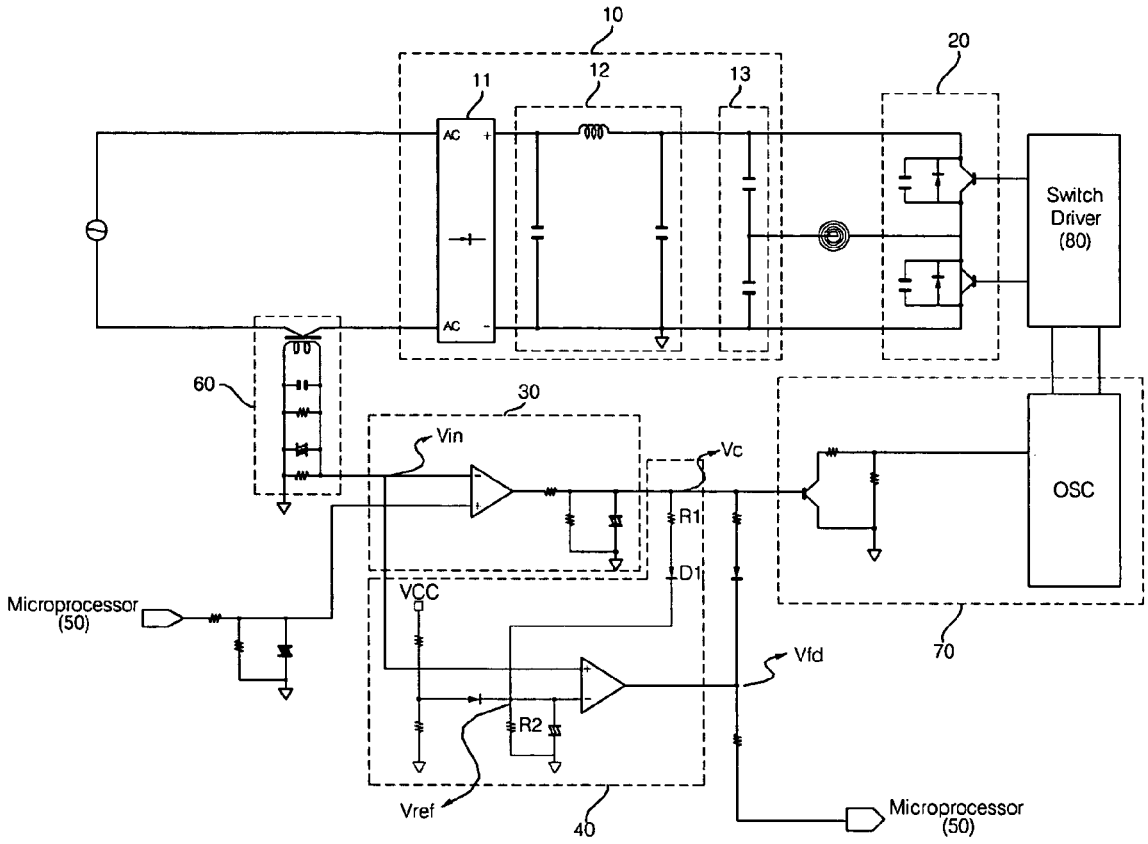
FIG. 4 is a circuit diagram illustrating an induction-heating cooking apparatus, operation of which is blocked due to the eccentricity of the container according to the present invention.
Figure 5:
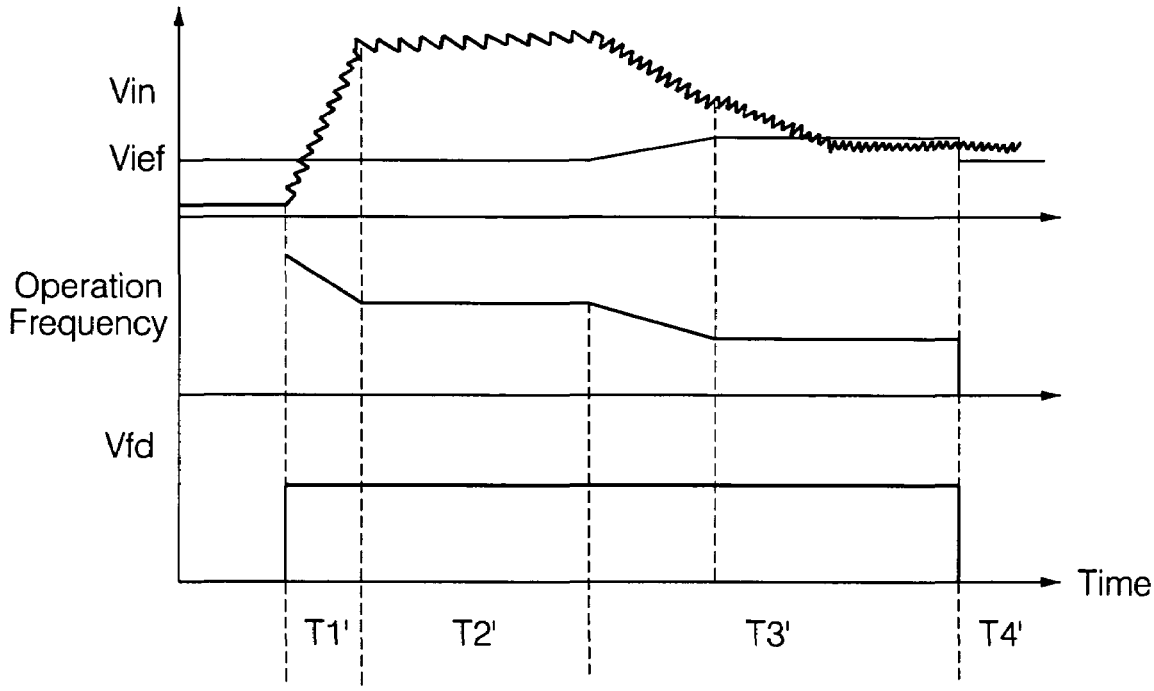
FIG. 5 is a graph illustrating operations of an inverter circuit when the eccentricity of a container occurs in the induction-heating cooking apparatus according to the present invention.

FIG. 4 is a circuit diagram illustrating an induction-heating cooking apparatus, operation of which is blocked due to the eccentricity of the container according to the present invention. FIG. 5 is a graph illustrating operations of an inverter circuit when the eccentricity of a container occurs in the induction-heating cooking apparatus according to the present invention. The circuit configuration of the induction-heating cooking apparatus according to the present invention will hereinafter be described with reference to FIG. 4.

Referring to FIG. 4, the inverter circuit includes a switch, switches on the switch upon receiving a control signal from a microprocessor 50 capable of generating the control signal according to cooking commands, for example, a cooking temperature, a cooking time, and a cooking method, etc., such that it provides a coil with a power-supply signal, thereby heating a container located on the coil.

In this case, the container including food acts as a cooking load, and provides the coil with the power-supply signal, such that the inverter circuit heats the cooking load.

Also, in the case of an induction-heating cooking apparatus such as a cook-top, the container is seated at a position (i.e., a cook zone) at which the coil is wound. If the container escapes from the cook zone, the occurrence of the container eccentricity is determined. If the container completely escapes from the cook zone due to high-eccentricity of the container, this is called a no-load state in which there is no cooking load.

The above-mentioned inverter circuit includes a power-supply unit 10 and an inverter unit 20. The power-supply unit 10 includes an AC power-supply unit 11 for generating a common AC power-supply signal; a rectifier 12 for rectifying the AC power-supply unit 11; and a filter unit 13 for filtering a power-supply signal rectified by the rectifier 12.

The AC power-supply unit 11 may be different in all countries or states, but the present invention exemplarily uses an AC power-supply signal of 220V at 60 Hz. The rectifier 12 rectifies the AC power-supply signal into a predetermined signal of 220V at 120 Hz using a rectifying diode. The filter unit 13 filters the rectified power-supply signal received from the rectifier 12, generates a DC power-supply signal, and outputs the DC power-supply signal to the inverter unit 20.

The inverter unit 20 switches on the switch upon receiving the DC power-supply signal, provides the coil with a current signal, and thus heats the container.

In order to stably operate the power-supply unit 10 and the inverter unit 20, an input signal detector 60, a constant-output controller 30, a small-load detector 40, a pulse generator 70, and a switch driver 80 are connected to each other.

The input signal detector 60 is directly connected to positive(+) and negative(−) terminals of the AC power-supply unit, such that it detects a current level and an input frequency. As a result, although the AC power-supply signal is changed by noise or an input power-supply signal is unstable, the input signal detector 60 prevents the inverter circuit from being damaged.

The constant-output controller 30 includes a differential amplifier in which a negative(−) terminal receives the input signal detected by the input signal detector 60 and a positive (+) terminal receives a constant-output control signal for an output control function from the microprocessor 50. The constant-output controller 30 generates a pulse-width control signal Vc for controlling a driving pulse width to compensate for the output power according to a differential component.

The pulse generator 70 drives a transistor upon receiving the pulse-width control signal from the constant-output controller 30, and adjusts resistance of an oscillator (OSC), such that it changes the width of a driving pulse and the oscillator (OSC) outputs the driving pulse.

If the width of the driving pulse is reduced, i.e., if the switching operation is performed at a high operation frequency, the output power is reduced. If the width of the driving pulse is increased, i.e., if the switching operation is performed at a low operation frequency, the output power of the inverter circuit is increased, such that a large amount of heat is supplied to the container.

If the input signal Vin detected by the input signal detector 60 is higher than the constant-output control signal (i.e., a reference value) generated from the microprocessor 50, the pulse generator 70 generates a first driving pulse whose pulse width is reduced by the pulse width control signal (Vc), thereby reducing the output power. Otherwise, if the input signal Vin is less than the reference control signal, the pulse generator 70 generates a second driving pulse whose pulse width is increased, thereby increasing the output power.

In this way, the pulse-width-controller driving pulse is applied to a gate of the switch contained in the inverter unit 20, switches on the switch, and provides the coil with a predetermined current, such that the cooking apparatus according to the present invention maintains a predetermined output power level irrespective of a variation of the input signal.

Furthermore, the induction-heating cooking apparatus further includes a small-load detector 40 for determining if the cooking load is less than the reference load, and blocking the inverter unit 20 from being driven when the cooking load is less than the reference load.

The small-load detector 40 includes a differential amplifier in which a positive(+) terminal receives the input signal Vin detected by the input signal detector 60 and a negative (−) terminal receives a reference signal Vref for determining whether the cooking load is considered to be a small load. A differential component Vfd applied to the above-mentioned positive(+) and negative(−) terminals is a feedback signal for blocking or maintaining the switching operation, and is applied to the microprocessor 50.

In this case, the small-load reference signal Vref is not equal to the value of Vcc fixed by a designer, the pulse-width control signal Vc generated from the constant-output controller 30 is received in the small-load detector 40, such that it is changed according to the detected input signal Vin.

Referring to the circuit configuration of the small-load detector 40, the negative(−) terminal receiving the small-load reference signal Vref is connected in parallel to a resistor R2 and a capacitor, and receives the pulse-width control signal Vc from the constant-output controller 30 via a resistor R1 and a diode D1.

In other words, the small-load reference signal Vref received in the negative(−) terminal can be denoted by the following equation:

$$Vref=(Vc-V_{d1})\times R2+(R1+R2)$$

In the above equation, $V_{d1}$ is a voltage applied to a diode D1. A circuit designer may synchronize the reference signal for determining the presence or absence of the small load with the pulse-width control signal Vc by controlling R1 and R2 values.

Therefore, the small-load detector 40 can determine the presence or absence of no-load state during the initial operation. Also, although the eccentricity of the cooking container occurs in a normal heating operation after the output power has been set to a high power level so that the container completely escapes from a predetermined cook zone, the small-load detector 40 determines the occurrence of the no-load state, such that the microprocessor 50 blocks the inverter unit 20 from being operated.

In more detail, if the eccentricity of the container occurs in the normal heating operation, the input signal Vin detected by the input signal detector 60 is reduced, and resonance inductance caused by the coil is changed, so that the constant-output controller 30 extends the pulse-width control signal Vc capable of extending a driving pulse width to compensate for the output power.

In this way, the higher the pulse width control signal Vc, the higher the small load reference signal Vref. The small-load detector 40 can determine the presence or absence of a small-load state (i.e., a no-load state) although the container eccentricity occurs in the normal heating operation, such that it outputs a control signal for blocking the operation of the inverter unit 20 to the microprocessor 50.

As a result, the present invention can solve the aforementioned problems of the conventional art which is unable to detect the no-load state during the normal heating operation so that it must maintain the driving of the inverter circuit.

Figure 3:
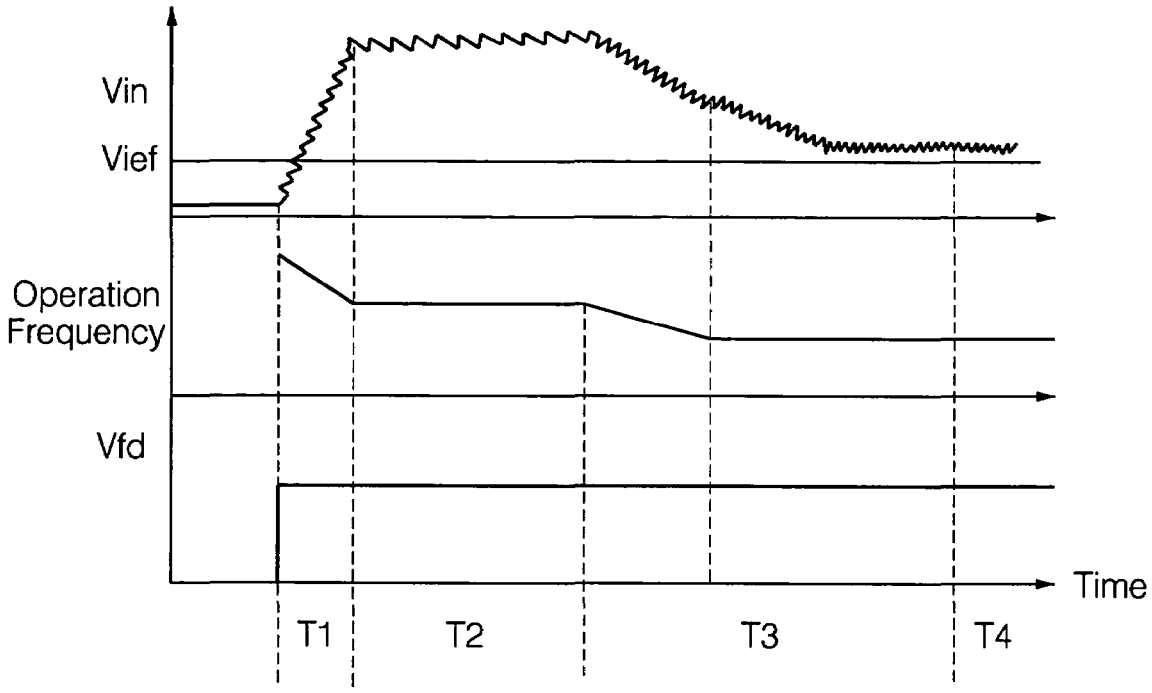
FIG. 3 (Prior Art)
FIG. 3 is a graph illustrating operations of an inverter circuit when the eccentricity of a container occurs in the conventional induction-heating cooking apparatus.

Operations of the inverter circuit for use in the induction-heating cooking apparatus if the eccentricity of the container occurs will hereinafter be described with reference to FIG. 5. The graph of FIG. 5 is compared with that of FIG. 3 for the convenience of description and better understanding of the present invention.

In FIG. 5, an operation frequency is continuously reduced during the initial driving period T1', so that an output power level is increased. The higher the output power level, the higher the input signal Vin applied to the circuit. If the output power reaches a constant-output level, the input signal Vin enters a normal operation period T2', so that a predetermined power level is generated, and a constant heat source is supplied to the induction-heating cooking apparatus.

In this case, during an eccentric period T3' during which the eccentricity of the cooking container occurs, the input signal Vin received in the circuit is continuously reduced, at the same time an operation frequency for a constant-output control function is also reduced, and the operation frequency maintains the lowest operation frequency defined by a circuit designer.

Differently from the conventional art, the present invention controls the reference signal Vref to be synchronized with the pulse-width control signal generated from the constant-output controller, so that the reference signal Vref is also increased if the pulse-width control signal is increased in the eccentric period T3'.

If the degree of eccentricity of the container is increased and thus the container completely escapes from the cook zone as denoted by T4', the reference signal is also increased, so that the input signal Vin is less than the reference signal Vref. As a result, the small-load detector detects the no-load state, and the output signal Vfd of the small-load detector becomes zero, so that the microprocessor blocks the inverter unit from being operated.

As apparent from the above description, the above-mentioned induction-heating cooking apparatus, operation of which is blocked due to the eccentricity of the container, controls the reference signal Vref for detecting a small load to be synchronized with the pulse-width control signal generated from the constant-output controller. If the eccentricity of the container occurs in the normal heating operation and completely escapes from the cook zone, the microprocessor determines the occurrence of a no-load state, so that the operation of the inverter circuit can be blocked.

Therefore, the induction-heating cooking apparatus according to the present invention can solve the problems of the conventional art which has been designed to continuously heat the cook zone when the container escapes from the cook zone, such that it can enhance both stability of an inverter circuit system and stability of a manufactured product, can prevent the occurrence of an unexpected accident caused by a customer's mistake, and can also prevent the occurrence of unnecessary energy consumption.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An induction-heating cooking apparatus, operation of which is interrupted by container eccentricity comprising:

a power-supply unit for rectifying/filtering an AC power-supply signal, and providing a circuit of the induction-heating cooking apparatus with a power-supply signal;

an inverter unit for performing a switching operation upon receiving an input signal from the power-supply unit, and transmitting a current signal to a coil on which a cooking container is seated;

a constant-output controller for generating a pulse-width control signal to vary a width of a driving pulse applied to the inverter unit according to an input signal varying with the degree of eccentricity of the cooking container, such that it allows the inverter unit to generate a constant-output signal;

a small-load detector connected to an output terminal of the constant-output controller, for determining the absence of a cooking load when the input signal is less than a reference signal synchronized with the pulse-width control signal, and generating a feedback signal to interrupt an operation of the inverter unit; and a microprocessor for transmitting a constant-output control signal to the constant-output controller to allow the inverter unit to generate the constant-output signal, and interrupting the operation of the inverter unit when the feedback control signal is zero.

2. The apparatus according to claim 1, wherein the power-supply unit includes:

an AC power-supply unit for providing the induction-heating cooking apparatus with the AC power-supply signal;

a rectifier for rectifying the AC power-supply signal received from the AC power-supply unit; and a filter for filtering the rectified AC power-supply signal received from the rectifier, and transmitting the filtered AC power-supply signal acting as an input signal to the circuit.

3. The apparatus according to claim 1, wherein the constant-output controller generates the pulse-width control signal which reduces the width of the driving pulse when the input signal is higher than a reference constant-output control signal, and increases the width of the driving pulse when the input signal is equal to or less than the reference constant-output control signal.

4. The apparatus according to claim 3, further comprising:

a pulse generator for operating a transistor upon receiving the pulse-width control signal from the constant-output controller, adjusting resistance of an oscillator to vary a pulse width, and generating the driving pulse.

5. The apparatus according to claim 4, further comprising:

a switch driver for transmitting the driving pulse generated from the pulse generator to a gate of a switch contained in the inverter unit, and switching on the switch.

6. The apparatus according to claim 1, further comprising:

an input signal detector connected to the power-supply unit, for detecting the input signal varying with the cooking load.

7. The apparatus according to claim 6, wherein the small-load detector includes a differential amplifier in which the pulse-width control signal generated from the constant-output controller is divided by a resistance ratio, and the divided result is applied to a negative(−) terminal, and the input signal detected by the input signal detector is applied to a positive(+) terminal.

8. The apparatus according to claim 6, wherein the constant-output controller includes a differential amplifier in which the input signal detected by the input signal detector is applied to a negative(−) terminal, and the constant-output control signal generated from the microprocessor is applied to a positive(+) terminal.

* * * * *